US009814959B1

(12) United States Patent
Riera

(10) Patent No.: US 9,814,959 B1
(45) Date of Patent: Nov. 14, 2017

(54) EXERCISE AND TRAINING DEVICE

(71) Applicant: Javier Riera, Lima (PE)

(72) Inventor: Javier Riera, Lima (PE)

( * ) Notice: Subject to any disclaimer, the term of this patent is extended or adjusted under 35 U.S.C. 154(b) by 0 days.

(21) Appl. No.: 15/430,078

(22) Filed: Feb. 10, 2017

(51) Int. Cl.

| | |
|---|---|
| ***A63B 69/34*** | (2006.01) |
| ***A63B 69/22*** | (2006.01) |
| ***A63B 69/24*** | (2006.01) |
| ***A63B 69/20*** | (2006.01) |
| *A63B 69/00* | (2006.01) |

(52) U.S. Cl.
CPC ..... *A63B 69/20* (2013.01); *A63B 69/206* (2013.01); *A63B 69/004* (2013.01); *A63B 69/24* (2013.01); *A63B 2244/10* (2013.01)

(58) Field of Classification Search
CPC ..... A63B 27/00; A63B 27/02; A63B 69/004; A63B 69/20; A63B 69/203; A63B 69/24; A63B 69/26; A63B 2069/0044; A63B 2244/10; A63B 2244/102; A63B 2244/104; A63B 2244/106; A63B 69/0091; A63B 69/206; A63B 2069/0008; A63B 2069/0042
See application file for complete search history.

(56) References Cited

U.S. PATENT DOCUMENTS 2,392,538 A * 1/1946 Knudsen ..... A63B 27/00 16/444
3,866,912 A * 2/1975 Scainetti ..... A63B 69/0091 473/461
4,422,527 A * 12/1983 Schultz ..... A63B 27/00 182/187
4,572,504 A * 2/1986 DiBartolo ..... A63B 69/004 482/83
4,620,610 A * 11/1986 Southard ..... A63B 27/00 182/228.1
4,674,597 A * 6/1987 Humphrey ..... A63B 27/00 182/189
4,749,184 A * 6/1988 Tobin ..... A63B 69/0091 482/129
4,913,419 A * 4/1990 McAuliffe ..... A63B 69/004 482/87
5,232,368 A * 8/1993 Morgia ..... A63B 69/20 273/DIG. 30
5,281,191 A * 1/1994 DeSousa ..... A63B 69/34 473/442
5,722,920 A * 3/1998 Bauer ..... A63B 69/004 482/83
5,800,319 A * 9/1998 Choate ..... A63B 69/34 482/83
6,033,348 A * 3/2000 Warshauer ..... A63B 69/004 482/83
6,063,011 A * 5/2000 Pelchat ..... A63B 69/004 482/83

(Continued)

*Primary Examiner* — Joshua Lee
(74) *Attorney, Agent, or Firm* — Sanchelima & Associates P.A.; Christian Sanchelima; Jesus Sanchelima

(57) ABSTRACT

The present invention provides an exercise and training device. The exercise and training device is adapted to be removably mounted to a vertical structure. The exercise and training device includes a paddle member that provides target surfaces; a support member that facilitates in aligning of the exercise and training device when mounted to the vertical structure; and a mounting member that mounts the exercise and training device about the vertical structure.

9 Claims, 5 Drawing Sheets

(56) References Cited

U.S. PATENT DOCUMENTS

| | | | | |
|---|---|---|---|---|
| 6,302,831 | B1 * | 10/2001 | Henry | A63B 69/004 482/83 |
| 7,591,768 | B1 * | 9/2009 | Geeting | A63B 69/004 482/83 |
| 7,938,759 | B1 * | 5/2011 | Gaynor | A63B 69/004 482/83 |
| 7,959,528 | B1 * | 6/2011 | Wilkes | A63B 69/0002 473/451 |
| 9,017,227 | B1 * | 4/2015 | Vargas | A63B 69/34 482/83 |
| 9,022,904 | B1 * | 5/2015 | Dorsey, III | A63B 69/004 482/83 |
| 9,211,465 | B1 * | 12/2015 | Lambrinos | A63B 69/34 |
| 2008/0032872 | A1 * | 2/2008 | Nappier | A63B 69/34 482/83 |
| 2009/0300888 | A1 * | 12/2009 | Shiue | A61F 9/027 24/193 |
| 2010/0155178 | A1 * | 6/2010 | Merritt | A63B 27/00 182/136 |
| 2014/0080681 | A1 * | 3/2014 | Knight | A63B 69/34 482/83 |

* cited by examiner

EXERCISE AND TRAINING DEVICE

BACKGROUND OF THE INVENTION

1. Field of the Invention

The present disclosure generally relates to an exercise and training device; and more particularly to an exercise and training device adapted to be portable and removably mountable to a vertical structure.

2. Description of the Related Art

Competitive sports, such as boxing or martial arts, involve training in coordination and striking technique. The most common training technique involves the practitioner using a striking paddle which is basically a paddled bag. There are many different types of striking paddle with varying sizes and configurations, based on various practicing techniques. Generally, during practicing, the striking paddle are held by a trainer or some person while the practitioner hits the striking paddle. However, this is not always possible or practical due to the costs associated with using a trainer. Furthermore, such training is limited by the ability and expertise of the person to steadily and properly hold the striking paddle at a required length and height, as required for different practicing techniques.

Some training devices, instead, include stands to which the paddle are firmly mounted. For example, these training device, typically, include a weighted base unit supporting a vertical stand to which the striking paddle are mounted. These training devices, in itself, are freestanding and require no mounting or support structures. Since the training devices require withstanding lot of punches and kicks; as a result, these devices tend to be bulky and/or permanent fixtures. As such, these training devices, with fixed stands, are not portable enough to be easily moved to different locations and further not compact enough to be easily stored when not in use.

Applicant believes that a related reference corresponds to U.S. Patent Application No. 20140080681 (hereinafter referred to as '681 application), issued to Tommy Jubei Knight, which discloses a martial arts training device. The martial arts training device of the '681 application includes a target for attachment to a punching bag. The target is a hollow shell containing a filler material. The shell is fixed to a strap that includes a mechanism for securing the strap around a punching bag. Although the '681 application provides a martial arts training device which may be removably attached to a punching bag; however, the said device has a fixed length strap which may only be suitable to strap the device over a particular sized punching bag, and not necessarily to any other structure. Therefore, there is a need for an exercising and training device which may be portable, easy and quick to setup, and further may be used in various settings and locations.

Other documents describing the closest subject matter provide for a number of more or less complicated features that fail to solve the problem in an efficient and economical way. None of these patents suggest the novel features of the present invention.

SUMMARY OF THE INVENTION

An objective of the present invention is to provide an exercise and training device which is adapted to be removably mountable to any vertical structure, such that the exercise and training device could be setup in various settings and locations.

Another objective of the present invention is to provide an exercise and training device which is portable, easy and quick to setup.

Yet another objective of the present invention is to provide an exercise and training device of simple construction which overcomes problems and satisfies needs existing in the art, and achieves the above objective in a simple, effective and inexpensive manner.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description, the words "comprise," "comprising," and the like are to be construed in an inclusive sense as opposed to an exclusive or exhaustive sense; that is to say, in the sense of "including, but not limited to." Words using the singular or plural number also include the plural or singular number, respectively. Additionally, the words "herein," "above," "below", etc., when used in this application, shall refer to this application as a whole and not to any particular portions of this application.

Figure 1:
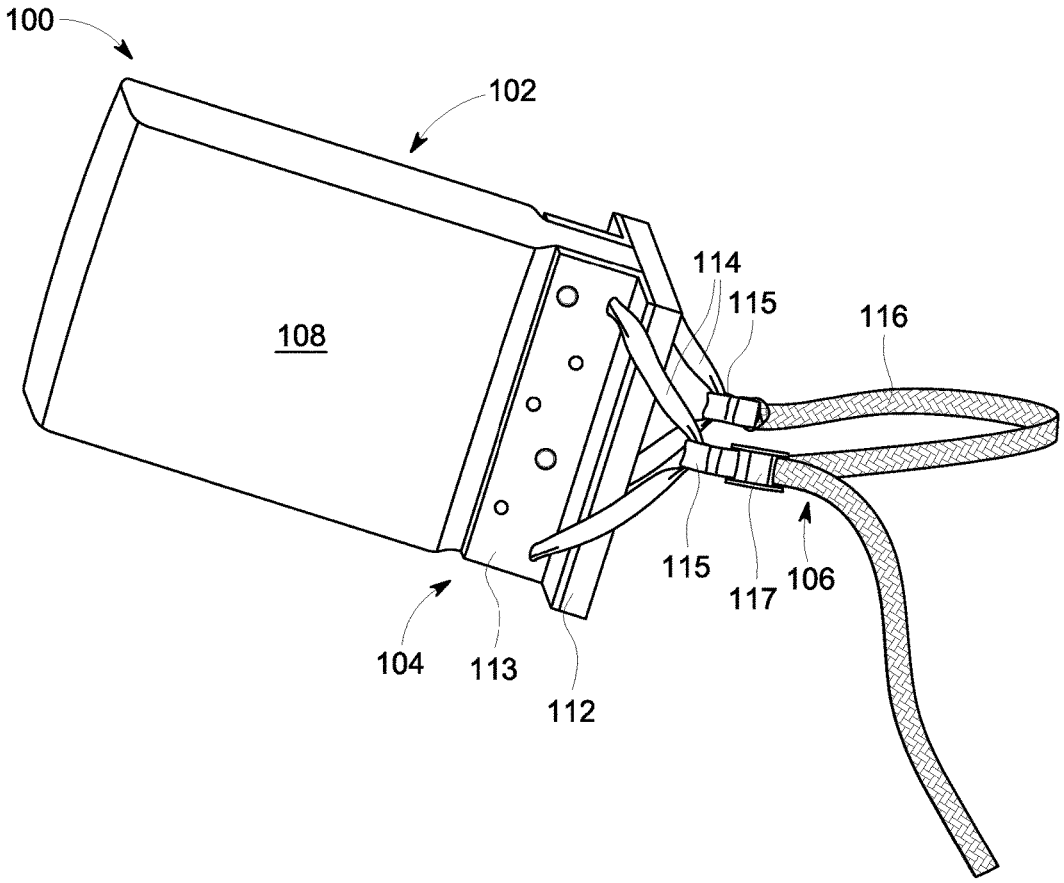
FIG. 1 illustrates a side perspective view of an exercise and training device, in accordance with an embodiment of the present disclosure.

FIG. 1 illustrates a side perspective view of an exercise and training device, referenced generally by the numeral 100; and hereinafter simply referred to as "training device 100". The training device 100 of the present invention may be used by a practitioner in training for martial arts, self-defense, combat, fight training, or the like. As may be seen from FIGS. 3-5, the training device 100 is adaptable to be mounted to a vertical structure, referenced by the symbol 'V'. In the illustrated example, the vertical structure 'V' is shown as a pole; however, it may be contemplated that the vertical structure 'V' may be a tree, a stand, among others. In accordance with an embodiment of the present invention, the training device 100, generally, includes a paddle member 102, a support member 104 and a mounting member 106 which are disposed in connection with each other.

In an embodiment, the paddle member 102 may have a, generally, polygonal shape. Specifically, as illustrated in FIG. 1, the paddle member 102 may have a truncated pyramidal shape; or in other words, a cross-sectional shape of an isosceles trapezoid. In other examples, the paddle member 102 may have rounded shapes, such as semi-spherical or rounded polygonal shapes. In one example, the paddle member 102 may have a smaller length along one edge compared to the other edge, imparting the paddle member 102, generally, a rectangular shape. Further, one or more edges of the paddle member 102 may be rounded so that the practitioner may not get hurt as he/she strikes an edge of the paddle member 102 of the training device 100. Further, the paddle member 102 may be of size to provide sufficient area for training purposes. It may be contemplated that that the present invention may be applicable to paddle members of any shape and size, as long as at least a portion of the paddle member is shaped to be struck by the practitioner.

In an embodiment of the present invention, the paddle member 102 is made of dense, relatively stiff paddling. The stiffness of the paddle member 102, compared to its relatively short length, allows it to be held at its ends and to receive strikes near its center area without deflecting excessively. In one example, the paddle member 102 may include two inner cushioning layers (not shown), a first cushioning layer and a second cushioning layer, of different firmness; and where the first cushioning layer forms a first target surface 108 and the second cushioning layer forms a second target surface 110, of the paddle member 102. As per one configuration, the first cushioning layer is preferably relatively rigid and the second cushioning layer is preferably resilient, so as to provide the practitioner with options to orient the training device 100 to face rigid first target surface 108 or resilient second target surface 110, as per his/her training requirements. In some examples, the paddle member 102 may include a flexible sheath surrounding thereof.

Figure 2:
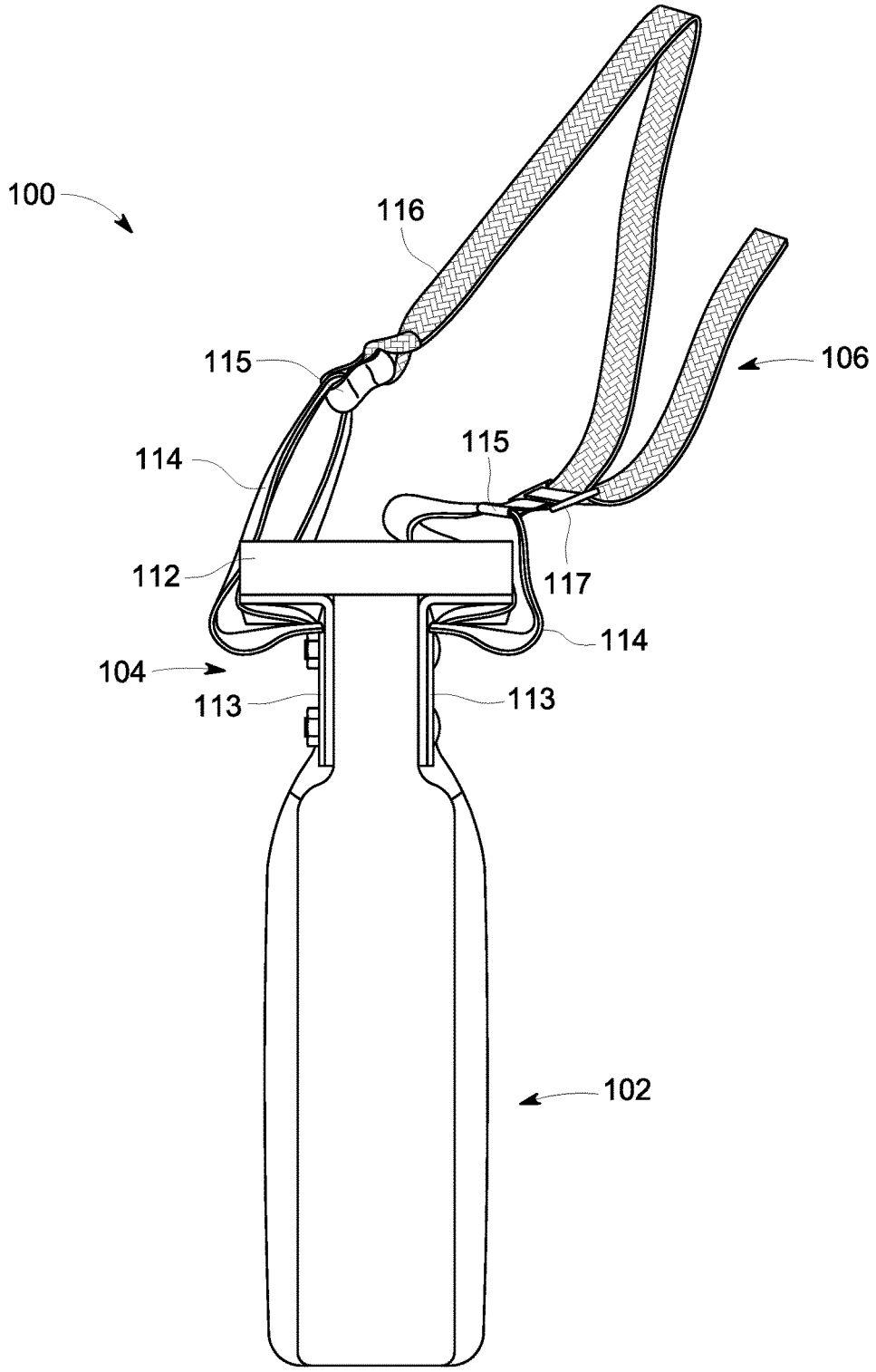
FIG. 2 illustrates a side view of the exercise and training device, in accordance with an embodiment of the present disclosure.

Referring to FIGS. 1-2, it may be seen that the support member 104 of the training device 100 may be fixed to one of the short edges of the paddle member 102. In one example, the support member 104 may include a solid base 112, and two angled brackets 113 sandwiching the paddle member 102 and fixed to the base 112. It may be contemplated that the support member 104 may provide a U-shaped channel (not shown) between the two angled brackets 113, where the said short edge of the paddle member 102 rests in the said U-shaped channel; and further the support member 104, or specifically the two angled brackets 113 are fixed to the paddle member 102 using fastening means, for example, nuts and bolts, or the like.

In one embodiment, the mounting member 106, of the training device 100, may include at least two straps 114 connected to the support member 104. It may be seen that each of the straps 114 may be connected at both its ends with opposite sides of the support member 104, forming a circlet. In one example, the straps 114 may be formed of flexible nylon material. Alternatively, the straps 114 may be formed of ropes, steel threads, or any material of good tensile strength. The mounting member 106 may also include two loops 115 secured with each of the two straps 114. As illustrated, the loops 115 may be coupled to the straps 114, one for each strap 114, at substantially in a middle thereof.

The mounting member 106 may also include a band 116 connected to one of the two straps 114. Specifically, the band 116 may be secured at one end with the loop 115 of the corresponding strap 114, with its other end being a free end. Further, the mounting member 106 may include a ratchet 117 provided with other of the two loops 115. Specifically, the ratchet 117 may be fixedly attached with the loop 115. In one embodiment of the present disclosure, the band 116 may be adapted to pass through the ratchet 117 from its free end such that the length of the band 116 may be adjusted by locking the band 116 at a desired position by means of the ratchet 117. Such length adjusting ratchet arrangements are well known in the art and thus have not been described herein for the brevity of the disclosure.

Figure 3:
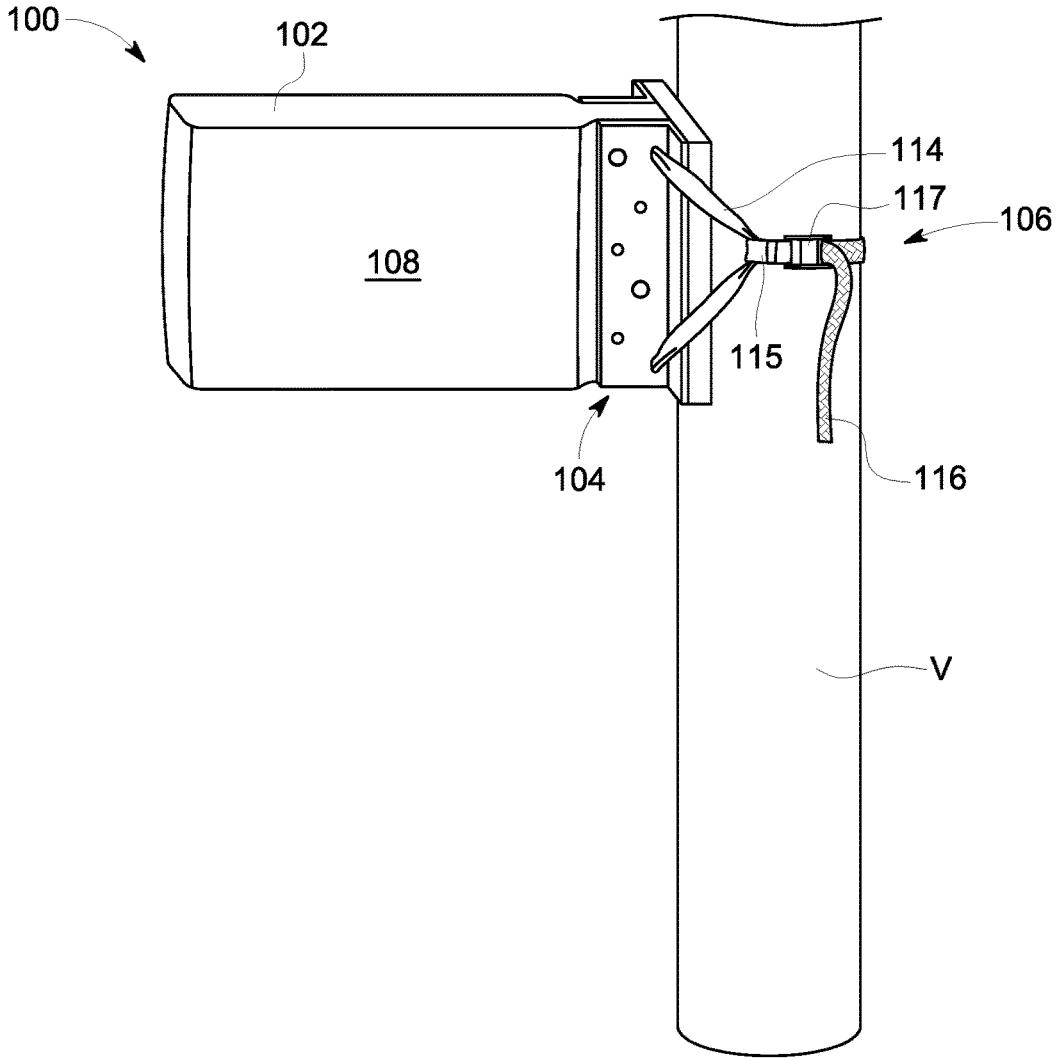
FIG. 3 illustrates an exemplary training environment with the exercise and training device mounted to a vertical structure.

It may be understood from FIG. 3, as the band 116 encircles the vertical structure 'V', the band 116 may be locked with the ratchet 117 at a desired position to tightly snug and mount the training device 100 about the vertical structure 'V'. It may be understood that the length of the band 116 may be adjusted based on a circumference of the vertical structure 'V'. In one example, the length of the band 116 of the mounting member 106 may be sufficient to be able to at least mount the training device 100 to a typical punching bag or the like, and the length of the band 116 may later may be reduced for structures having smaller circumferences as desired. It may be contemplated that the vertical structure 'V' does not necessarily needs to be circular in cross-section and may have any suitable cross-sectional shape, such as, but not limited to, square, rectangle, trapezoidal, etc.

In the present configuration of the mounting member 106, in one of the examples, the band 116 may be connected to the support member 104, via the strap 114, the loop 115 and the ratchet 117. The said preferred example provides an advantage that the straps 114 and the band 116, together, act as tensioning means for proper alignment of the training device 100 when mounted to the vertical structure 'V'. Alternatively, the band 116 may be directly connected to the support member 104; for example, the support member 104 may have a slot through which the band 116 passes, such that a center of length of the band 116 rests near the slot. In other alternate examples, the mounting member 106 may use loop and hook fastening arrangement, pin and holes arrangement, adhesive arrangement or any another known arrangement known in the art which may provide tight mounting of the training device 100 about the circumference of the vertical structure 'V'.

As discussed, the training device 100 of the present invention may be removably mounted to the vertical structure 'V'. This provides the practitioner with the flexibility of using the training device 100 at almost any location where any vertical structure is available. Further, since the training device 100 may be mounted to the vertical structure 'V', it allows the practitioner to practice solo/independently without the requirement of presence of a trainer to hold the training device 100. Also, since the training device 100 may be used in both horizontal as well as vertical orientations, and further both the target surfaces 108, 110 have different firmness; therefore, the training device 100 of the present invention may be used by practitioners of different sizes, strengths, experience and skill. In addition to its versatility of use, the present training device 100 is relatively inexpensive to manufacture and easy to clean. The relatively compact size of the training device 100 allows it to be easily stored away when not in use. Also, the straps 114 allow for easy transportation of the training device 100 when needs to be carried from one place to another.

Figure 4:
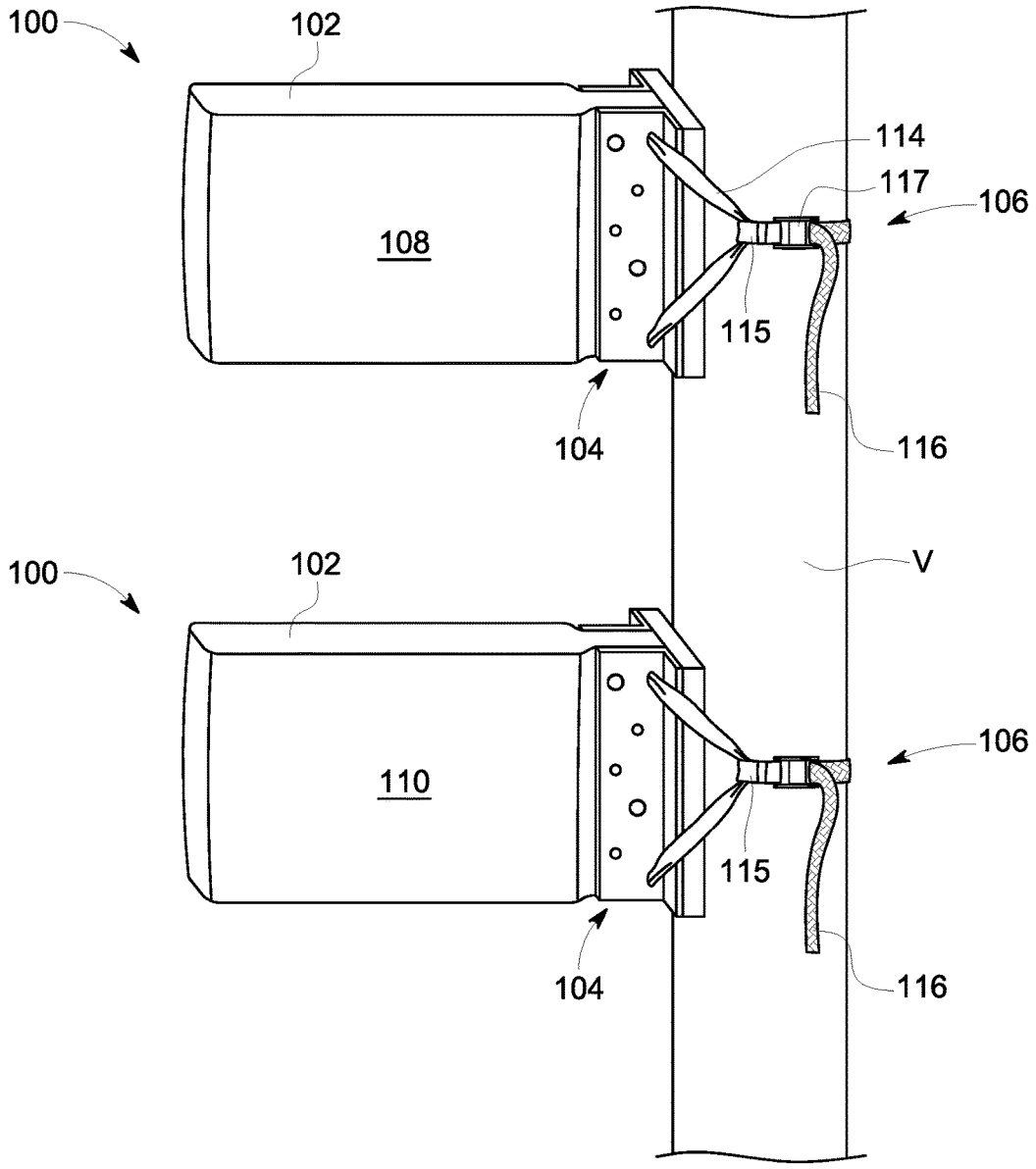
FIG. 4 illustrates an exemplary training environment with two exercise and training devices mounted to the vertical structure.
Figure 5:
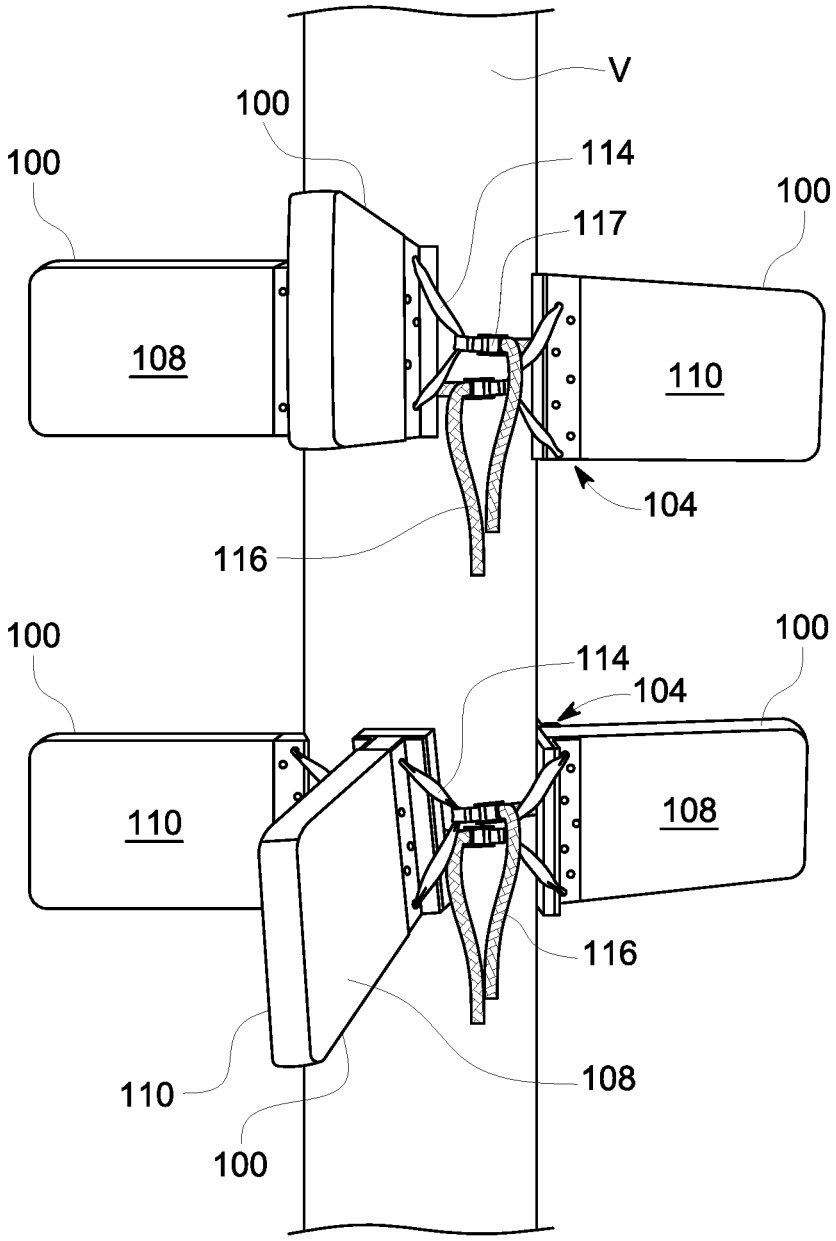
FIG. 5 illustrates an exemplary training environment with plurality of exercise and training devices mounted to the vertical structure.

In some examples, two or more training devices 100 may be mounted to a single vertical structure 'V'. FIG. 4 illustrates an example where two training devices 100 are mounted to the vertical structure 'V' such as the pole (as shown). As may be seen, the two training devices 100 are mounted at different heights; this allows the practitioner to practice different striking techniques. FIG. 5 illustrates another example where a plurality of training devices 100 is shown, mounted to a single vertical structure 'V'. Further, it may be seen that two or more training devices 100 are mounted at substantially a same vertical height above the ground. This is achievable since the mounting members 106 of these training devices 100 provide a simple and convenient arrangement for removably mounting thereof. Such arrangement may allow the practitioner to practice his/her speed and co-ordination techniques. In this manner, the training device 100 of the present invention may accommodate different practicing/exercising needs of the practitioner, e.g., punching versus kicking exercises, martial arts versus boxing, etc.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A training device mounted to a structure, comprising:

a paddle member having a distal end and a proximal end opposite each other, said proximal end having a first exterior surface and a second exterior surface opposite each other, said distal end being furthest away from said structure;

a base member;

two angled brackets sandwiching said proximal end;

at least one strap directly attached to one of said two angled brackets; and a band connected to said at least one strap and configured to wrap around said structure.

2. The training device of claim 1 wherein said structure is a tree, pole or post.

3. The training device of claim 1 wherein said band includes a ratchet system that cooperates with a buckle configuration extending from said at least one strap to create a secure engagement.

4. The training device of claim 1 wherein said structure has a horizontal configuration.

5. The training device of claim 1 wherein said band of said training device is mounted to a structure using a hook and loop fastener, adhesive, or pin and hole arrangement.

6. The training device of claim 1 wherein said at least one strap is made of nylon, steel or a material of high tensile strength.

7. The training device of claim 1 wherein said at least one strap each has a substantially V-shaped configuration when pulled by said band.

8. The training device of claim 1 wherein each of the two angled brackets has a first portion and a second portion, said first portion mounted parallel and flush to said first or second exterior surface, said second portion mounted perpendicularly and rigidly to said first portion, said base member mounted parallel and flush to said second portion and located perpendicular with respect to said paddle member, said base member being flat.

9. The training device of claim 1 wherein said proximal end has a reduced thickness with respect to the rest of said paddle member, said reduced thickness defined as a thickness between said first and second exterior surfaces.

* * * * *